US008710941B2

(12) United States Patent
Lee et al.

(10) Patent No.: US 8,710,941 B2
(45) Date of Patent: Apr. 29, 2014

(54) HIGH-ORDER HARMONIC DEVICE OF CAVITY FILTER

(75) Inventors: Chien-Chih Lee, Keelung (TW); Wei-Chin Hsu, Keelung (TW); Hsien-Wen Liu, Keelung (TW)

(73) Assignee: Universal Microwave Technology, Inc., Keelung (TW)

( * ) Notice: Subject to any disclaimer, the term of this patent is extended or adjusted under 35 U.S.C. 154(b) by 589 days.

(21) Appl. No.: 13/020,444

(22) Filed: Feb. 3, 2011

(65) Prior Publication Data

US 2012/0200374 A1 Aug. 9, 2012

(51) Int. Cl.
*H01P 1/205* (2006.01)
*H01P 7/04* (2006.01)

(52) U.S. Cl.
CPC .. *H01P 1/205* (2013.01); *H01P 7/04* (2013.01)
USPC ..... 333/203; 333/224; 333/207

(58) Field of Classification Search
USPC ..... 333/125, 126, 136, 137, 206–209, 333/222–224, 227, 228, 230–233, 203
See application file for complete search history.

(56) References Cited

U.S. PATENT DOCUMENTS 6,933,804 B2 * 8/2005 Rathgeber et al. ..... 333/134
7,463,121 B2 * 12/2008 D'Ostilio ..... 333/223
8,072,294 B2 * 12/2011 Tanpo et al. ..... 333/134

* cited by examiner

*Primary Examiner* — Benny Lee
*Assistant Examiner* — Gerald Stevens
(74) *Attorney, Agent, or Firm* — Muncy, Geissler, Olds & Lowe, P.C.

(57) ABSTRACT

A high-order harmonic device of a cavity filter including a base and a lid cover the base is disclosed. The base has a through groove connecting to an upper and a lower portion. The base has a plurality of output terminal with metallic conductor extending into the inner side formed on the surface of the sidewall. The base has resonance space formed indented to receive the metallic conductor and extending to connect to the through groove. The lid has a plurality of threading holes formed corresponding to chambers and partitions received with adjusting elements for height adjustment. The adjusting elements has the resonance bars corresponding to every chamber and the suppressing bars corresponding to every partition. By adjusting suppressing bar and the partition to a predetermined distance, the space of the channel for transmitting the high-order harmonic wave can be reduced to suppress noise produced by high-order harmonic wave.

5 Claims, 7 Drawing Sheets

HIGH-ORDER HARMONIC DEVICE OF CAVITY FILTER

BACKGROUND OF THE INVENTION

1. Field of the Invention

The present invention relates to a high-order harmonic device of a cavity filter. More particularly to a high-order harmonic device having a partition with a channel formed above connecting to adjacent cavities on the base, and a lid penetrated with a plurality of suppressing adjusting elements positioned facing the partitions. The partitions and the suppressing adjusting elements can suppress the space for transmitting signals by the high-order harmonic wave, and thereby suppress noise produced by the high-order harmonic wave in order to have signals more clearly and less distorted.

2. Description of the Related Art

The wireless communication is essential in the modern communication industry, for instance, in the broadcasting, wireless phone, mobile phone, Bluetooth, global positioning system (GPS), wireless network etc, wireless communication is applied everywhere in our daily life. The antenna technology plays a key role in the wireless communication, particularly for the long distance microwave communication of which involved even broader.

The antenna couples the electromagnetic wave in the air to convert it into the current signal and further transmits it to the devices connected at the primal end. In the process of coupling, the frequency response of the filter is very important; the good frequency response upgrades the sensitivity of coupling and providing precision for operating in the working bandwidth, and further filters the noise for playing the signal clearly.

Referring to FIG. 6, an input slot A1 is penetrated through the base A of the filter, and the base A has a resonance chamber A2 connecting to the input slot A1 and a plurality of chambers A21 conjunct to each other. The resonance chamber A2 has output ends A3 extending from the external sidewall to the inner portion at the two distal ends apart from the input slot A1. A lid B is positioned on the base A, and the lid B has a plurality of conducting elements B1 formed on the lower surface thereof to extend into every chamber A21. The frequency response conducted by the chambers A21 and the conducting elements B1 can upgrade the sensitivity while coupling.

However, with the increased territory and products of the wireless signal, and the bandwidth of the wireless signal and the wireless signals transmitted in the air is also increased, the interference between wireless signals in the air is becoming more severe (referring to FIG. 7) and the received signals can be invalid due to the unclearness and distortion.

Therefore, how to solve the above described defect is the priority issue for the manufacturers in the field.

SUMMARY OF THE INVENTION

The present invention has been accomplished under the circumstances in view. It is therefore the main object of the present invention to provide a high-order harmonic device of a cavity filter.

According to an aspect of the present invention, a partition with a channel is formed above connecting to adjacent cavities on the base, and a lid is penetrated with a plurality of suppressing adjusting elements of which positioning facing the partitions; the partitions and the suppressing adjusting elements can suppress the space for transmitting signals by the high-order harmonic wave, and thus suppress the noise produced by the high-order harmonic wave in order to have signals more clearly and less distorted.

The other aspect of the present invention is to have a space formed indented in the bottom of the top face of the partition. While having the lid covering the top surface of the base, every suppressing element does not contact the partition during adjustment, thus prevent ineffective filtration caused by the contact between the suppressing element and the partition. Because the repeated adjustment on the suppressing element is not necessary, the adjustment can be easy with less time consumption.

DETAILED DESCRIPTION OF THE PREFERRED EMBODIMENT

Figure 1:
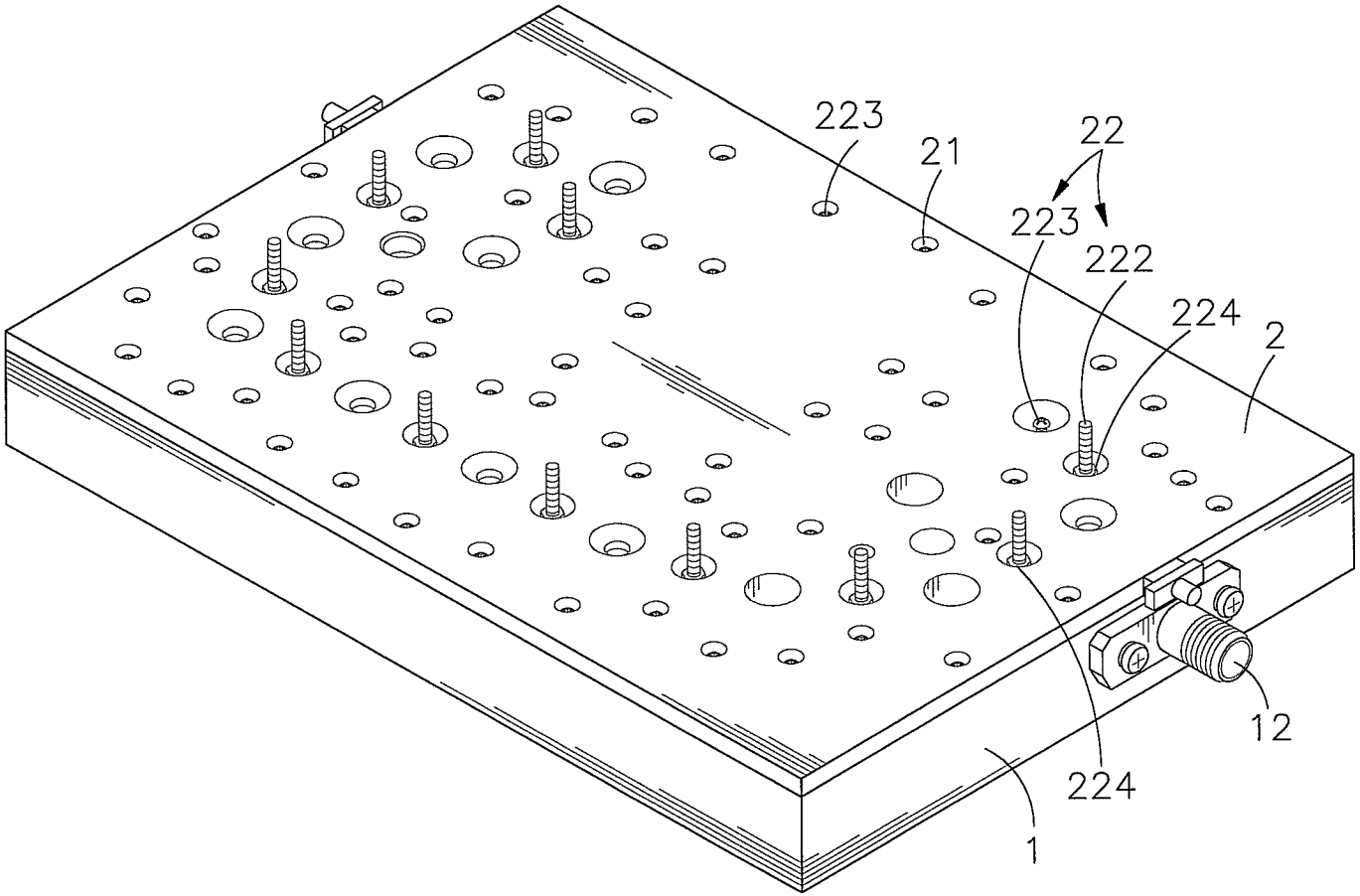
FIG. 1 is an elevational view according to a preferred embodiment of the present invention.

FIGS. 1, 2, 3 and 4 are an elevational, an exploded view, an elevational view and an elevational view of the base according to a preferred embodiment of the present invention. The high-order harmonic device of a cavity filter comprises a base 1 and a lid 2 covering the base 1.

The base 1 has a through groove 11 connecting the upper and the lower portion of the base 1, and a plurality of output terminals 12 positioned on the sidewall of the base 1. The output terminals 12 have metallic conductor 121, and the base 1 has a resonance space 13 formed indented for fitting the metallic conductor 121 and extend in a bent fashion go connect to the through groove 11. The resonance space 13 has a plurality of connected chambers 131 having resonant element 132 protruding at the bottom side, and of every chamber 132 has a groove 1321 from the indented downwardly extending from the top side thereof. Each adjacent chamber 131 has a partition 133 forming a channel 14 between the two sidewalls of the adjacent chambers 131.

The lid 2 has a plurality of threading holes 21 having female thread formed respectively corresponding to the positions of the groove 1321 of every resonant element 132 and every partition 133, and the threading holes 21 receive adjusting elements 22 with male thread for adjusting upper and lower positions; the plurality of adjusting elements 22 respectively have the resonance element 221 corresponding to the groove 1321 and the suppressing adjusting element 222 corresponding to the partitions 133.

Referring to FIGS. 1, 2, 3 and 4, to assemble the elements of the present invention, place the lid 2 onto the base 1 and allow the plurality of resonance elements 221 of the lid 2 extend respectively into the groove 1321 of every resonance 132; to position the plurality of suppressing adjusting elements 222 respectively to correspond the position of each partition 133. When the height of the resonance element 221 is adjusted, the area at the bottom of the groove 1321 and the resonance element 221 is altered accordingly; when the resonance element 221 is descending the coupling volume of the electromagnetic is gradually decreasing accordingly; when the resonance element is ascending, the coupling volume of the electromagnetic is gradually increasing accordingly, thus to adjust the coupling volume of the electromagnetic between the plurality of resonant element 132 in order to operate precisely within the working bandwidth.

Figure 5:
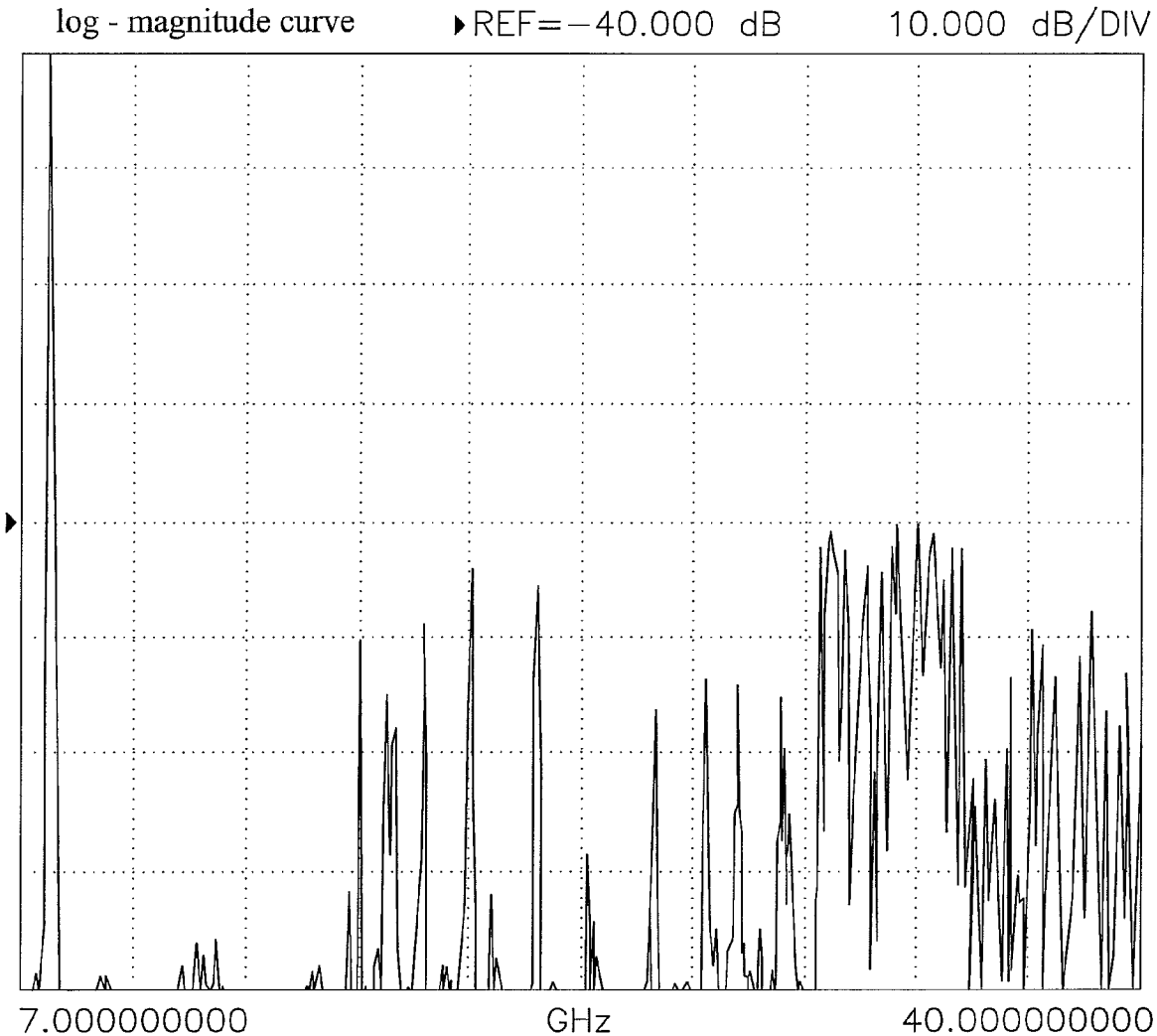
FIG. 5 is a noise measurement chart according to the present invention.
Figure 6:
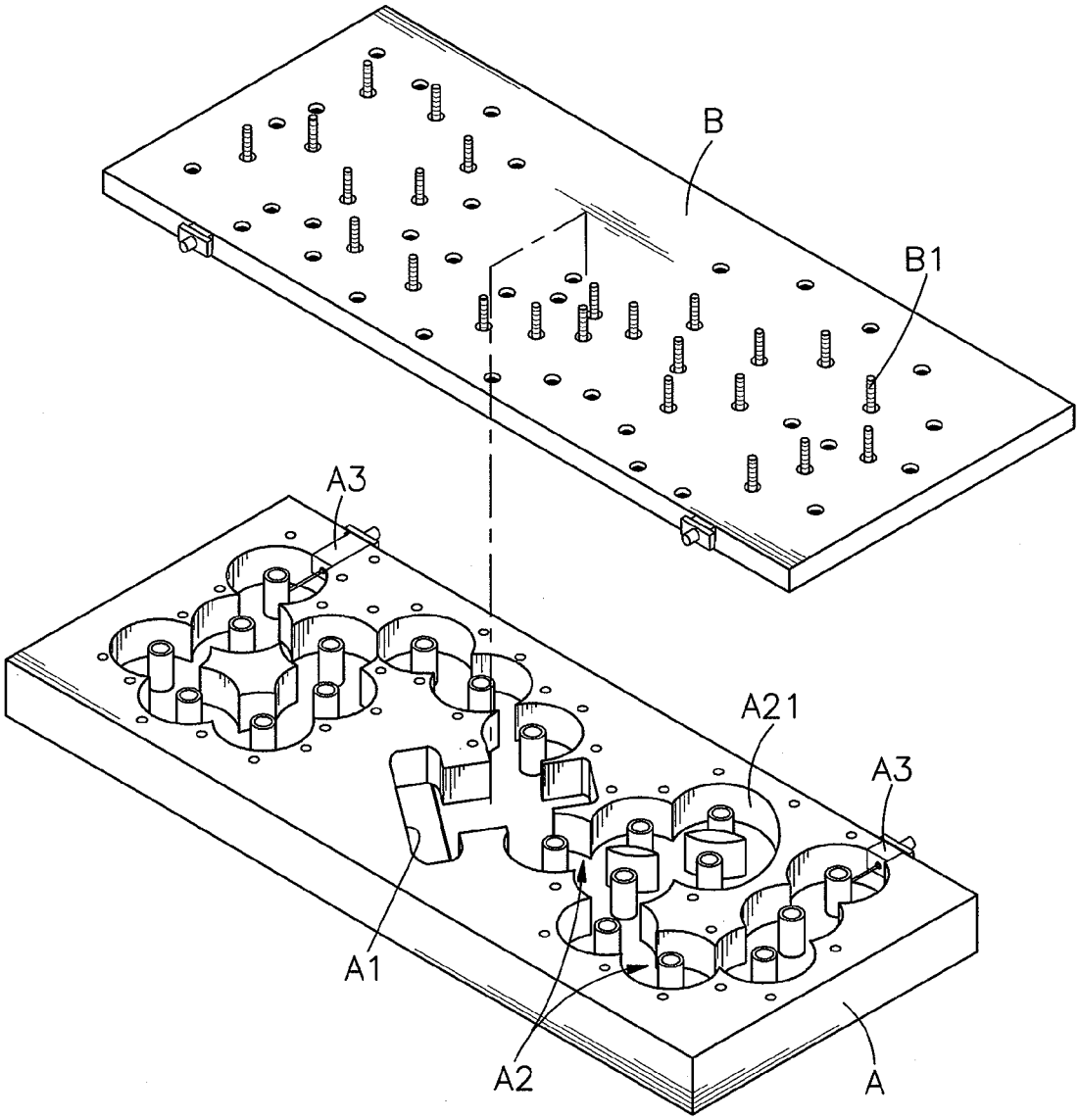
PRIOR ART FIG. 6
FIG. 6 is an exploded view according to a conventional invention art.
Figure 7:
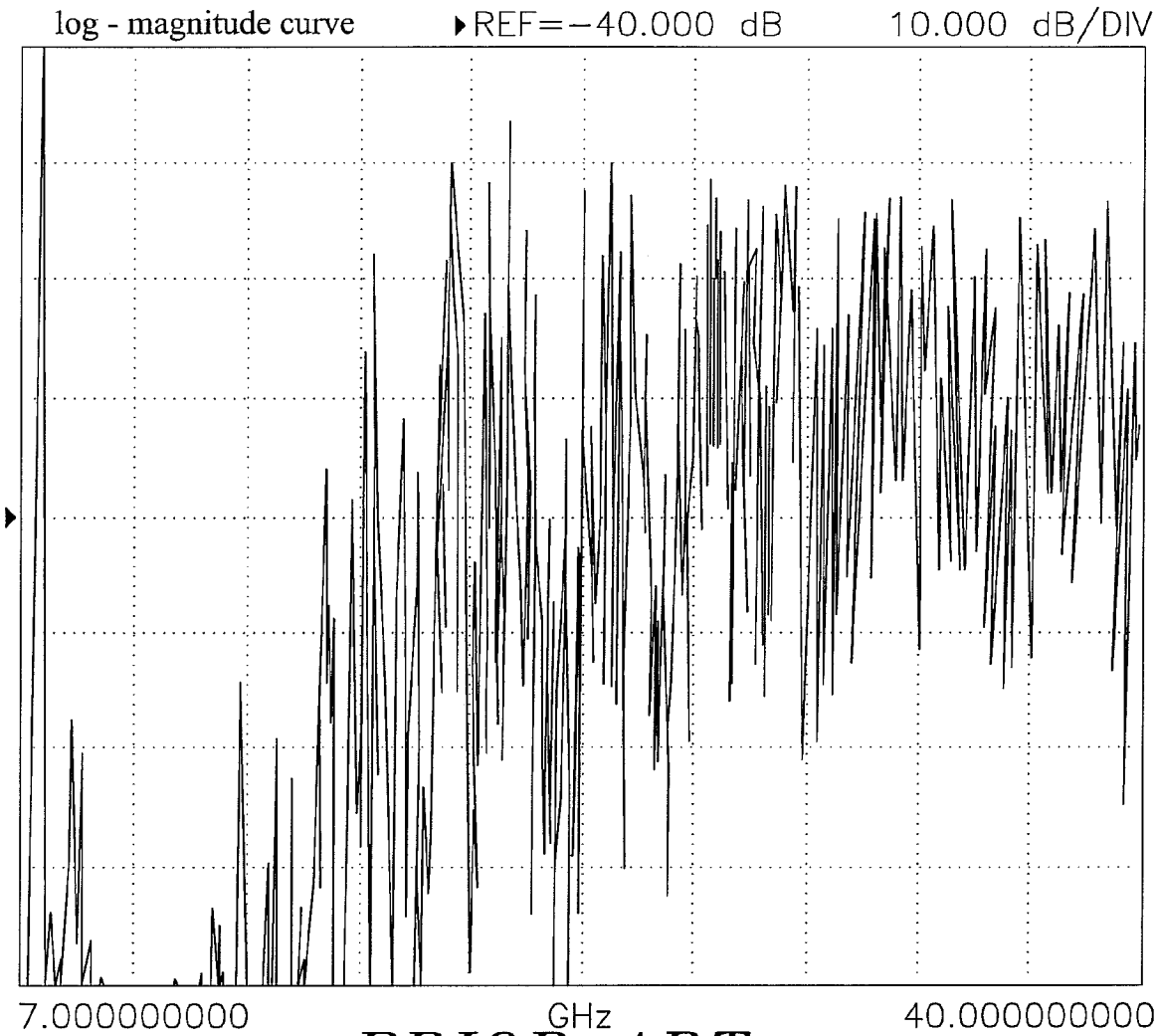
PRIOR ART FIG. 7
FIG. 7 is a noise measurement chart according to a conventional invention art.

Furthermore, the suppressing element 222 and the partitions 133 are adjusted to a certain distance to reduce the space of the channel 14 for the high-order harmonic wave to transmit the signal to suppress the high-order harmonic wave (referring to FIG. 5. The high-order harmonic wave noise is produced during the signal transmission and the above method can substantially filter the noise after receiving the signals to maintain the signal more clearly and less distortion.

Figure 2:
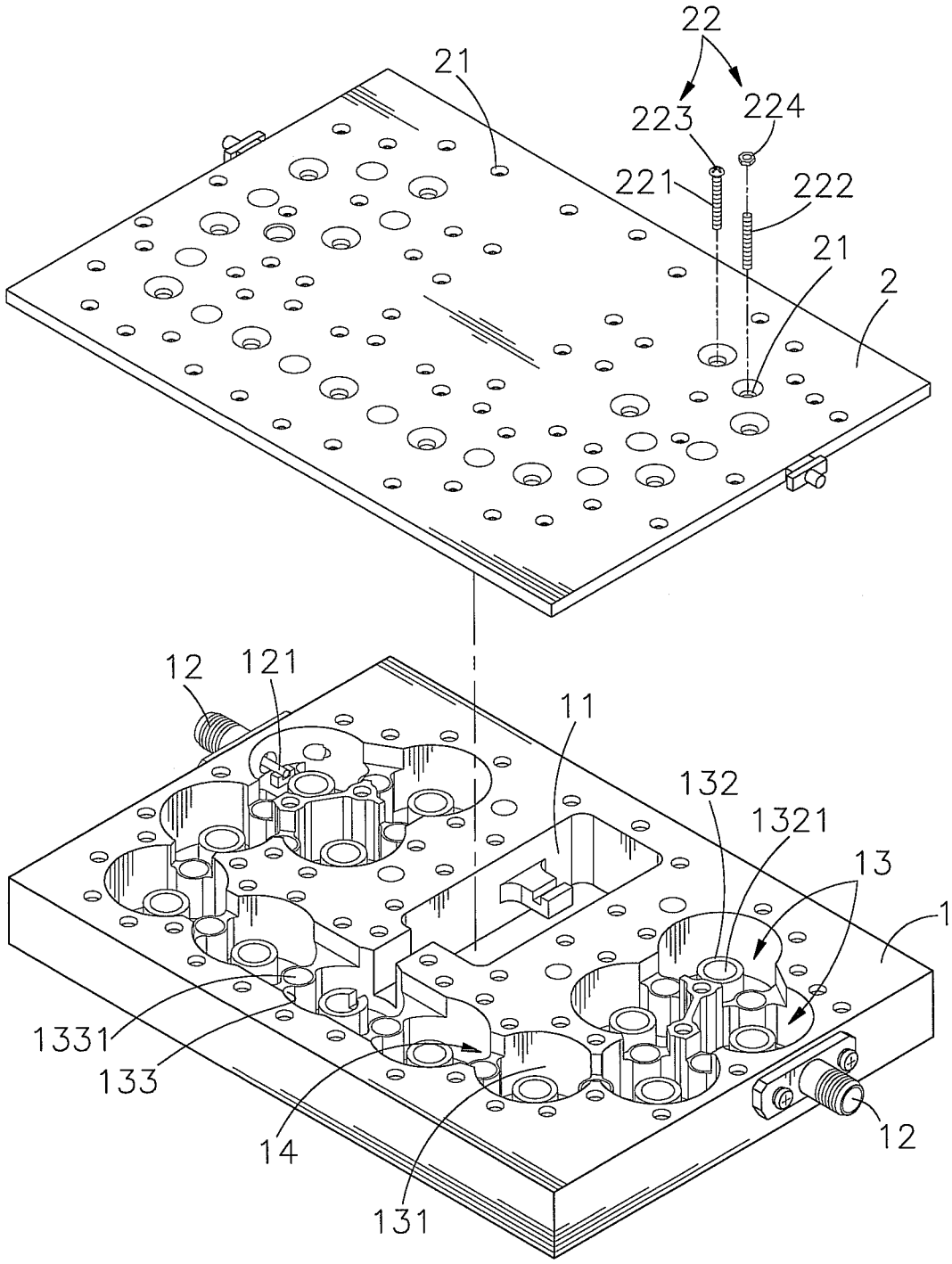
FIG. 2 is an exploded view according to a preferred embodiment of the present invention.
Figure 4:
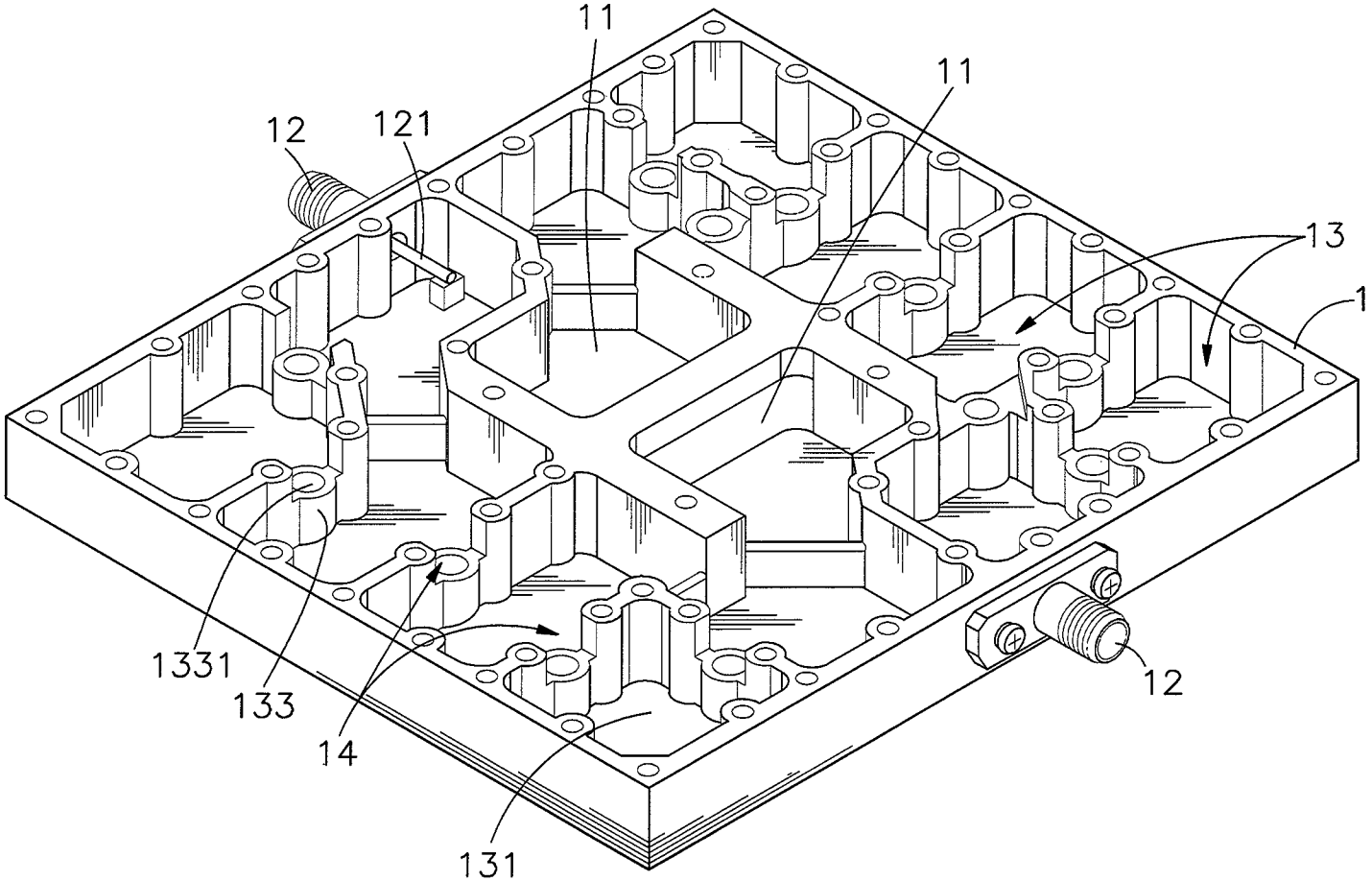
FIG. 4 is an elevational view of the base according to another preferred embodiment of the present invention.

Referring to FIGS. 2 and 4, the partition 133 may further comprise a space 1331 indented downwards on the top side for the suppressing element 222 to reach there-within. When the lid 2 covers the base 1 without showing the positions of the suppressing elements 222, the contact between the suppressing elements 222 and the corresponding partitions 133 can be avoided to prevent the problem of not being able to filter. Because the positions of the suppressing elements 222 need not be adjusted repeatedly, therefore, it can be more convenient, prompt and less time consuming while adjusting the suppressing elements 222.

Figure 3:
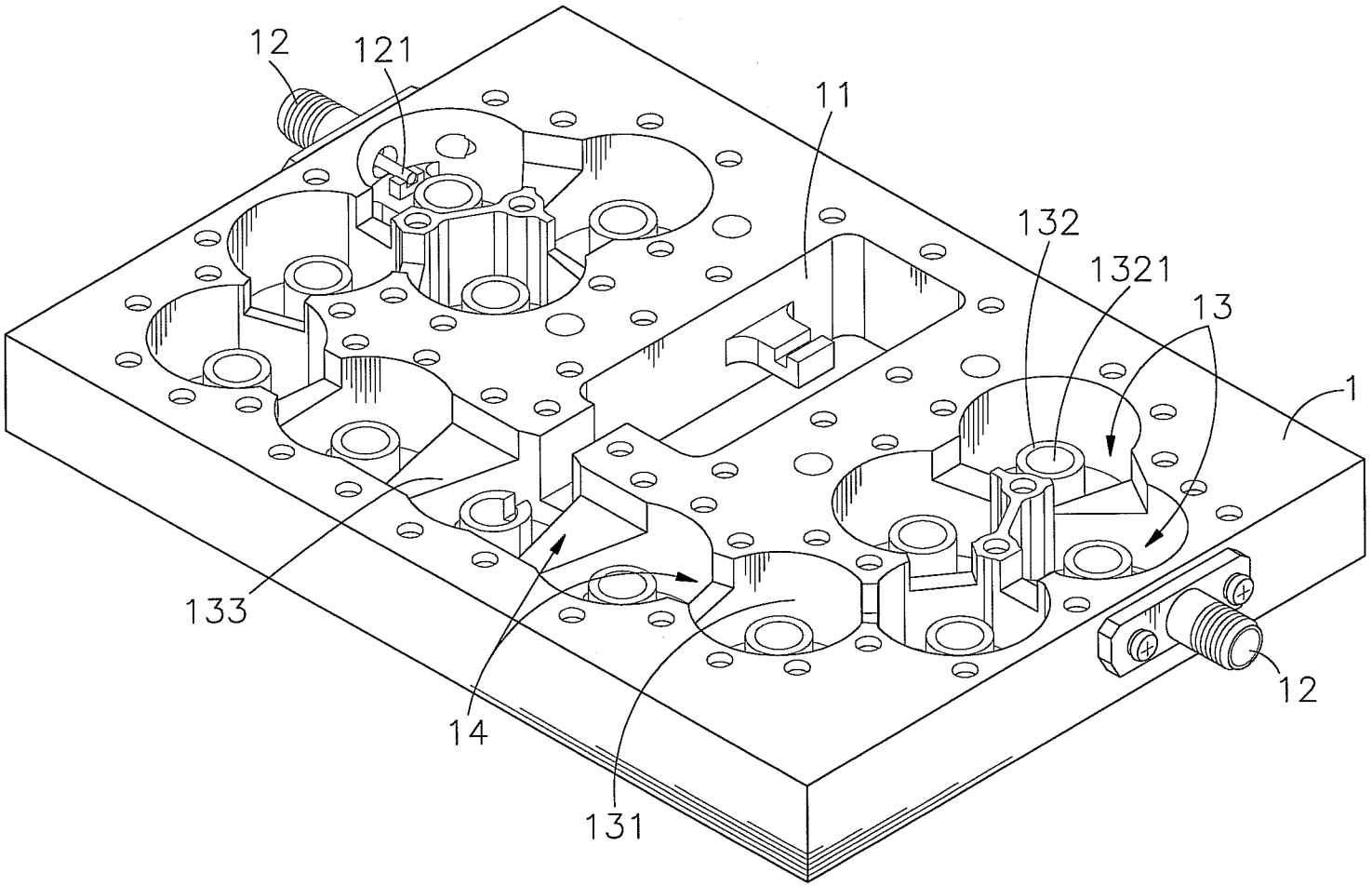
FIG. 3 is an elevational view of the base according to another preferred embodiment of the present invention.

Referring to FIGS. 2, 3 and 4 the plurality of chambers 131 of the base 1 can be formed in a shape of a circle, a rectangle or a polygon, and the plurality of chambers 131 can connect to one or two sides of the through groove 11. The chambers 131 can be either with or without the resonant element 132. The resonant element 132 is merely for providing the better precision for adjusting the electromagnetic coupling volume. Furthermore, the output terminals 12 can also position on a sidewall or two sidewalls of the base 1. The above description is used merely for demonstrating the embodiment, not for limiting the scope of the present invention. Any structural or illustrational alteration shall be construed to be within the scope of the present invention.

Referring to FIGS. 1 and 2, the plurality of adjustment elements 22 comprise resonance elements 221 and suppressing elements 222 to extend out of the top side of the lid 2 with the head 223, and the resonance elements 221 and the suppressing elements 222 extend out of the top side of the lid 2 with nuts 224. Thus, after placing the lid 2 onto the base 1, the resonance elements 221 and the suppressing elements 222 can be adjusted directly by hand of the hand tool for the various heights. The above description is used for merely demonstrating the embodiment, and not for limiting the scope of the present invention. Any structural or illustrational alteration shall be construed within the claim of the present invention.

The high-order harmonic device of the cavity filter of the present invention is more advantageous than the conventional art, for example:

1. The two connecting sidewalls of the adjacent chambers 131 of the base 1 are connected to the partitions of which having channel formed above, and the lid 2 has a plurality of suppressing elements 222 facing every partition 133; by adjusting every suppressing element 222 and the partition 133 to a predetermined distance the space of the channel 14 for transmitting the high-order harmonic wave can be reduced to substantially suppress the noise produced by the high-order harmonic wave.

2. The partition 133 can have the downwardly indented space 1331 on the top side to keep every suppressing element 222 away from the partition 133 after placing the lid 2 onto the base 1 while adjusting, and thereby obtain the filtration effect.

The high-order harmonic device of the cavity filter of the present invention has partitions 133 with a channel 14 formed above connecting to adjacent cavities on the base 1, and a lid 2 penetrated with a plurality of suppressing elements 222 of which positioning facing the partitions 133; the partitions 133 and the suppressing elements 222 can suppress the space for transmitting signals by the high-order harmonic wave, and thereby suppress the noise produced by the high-order harmonic wave in order to have signals more clearly and less distortion.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What the invention claimed is:

1. A high-order harmonic device of a cavity filter, comprising a base and a lid covering said base; wherein said base comprises a through groove connecting an upper and a lower portion of said base; said base has a plurality of output terminals on a surface of sidewalls of said base, each of said plurality of output terminals has a metallic conductor extending into said base; said base has a resonance space formed indented and bent providing said metallic conductors to reach in and connect to said through groove; said resonance space comprises a plurality of chambers; a respective one of a plurality of partitions having a channel formed above is formed on side walls of adjacent ones of the plurality of chambers, each of said partitions has a space indented downwards from a top side; said lid has a plurality of threading holes with female thread formed corresponding to each of said plurality of chambers and each of said partitions; each of said plurality of threading holes provides to thread with a corresponding adjusting element having male thread for a height adjustment; said plurality of adjusting elements respectively comprise a suppressing element positioned corresponding to a resonance element of each of said plurality of chambers and said each of said partitions in order to reduce spaces for a high-order harmonic wave to transmit signals; each of said resonance elements and each of said suppressing elements has a certain distance from a bottom side of a corresponding chamber of said plurality of chambers and each of said partitions.

2. A high-order harmonic device of a cavity filter according to claim 1, wherein each of said plurality of chambers of said base respectively comprises a protruded resonant element on said bottom side; each of said protruded resonant elements has a groove downwardly formed indented on a top side for a corresponding one of said resonance elements to reach in.

3. A high-order harmonic device of a cavity filter according to claim 1, wherein each of said partitions of said base further has a groove downwardly formed indented on a top side for a corresponding one of said suppressing elements to reach within.

4. A high-order harmonic device of a cavity filter according to claim 1, wherein each of said resonance elements and each of said suppressing elements of said plurality of adjusting elements of said lid has a distal end extending out from said lid with a head.

5. A high-order harmonic device of a cavity filter according to claim 1, wherein each of said resonance elements and each of said suppressing elements of said plurality of adjusting elements of said lid has a distal end extending out from said lid with a nut.

* * * * *